US012416217B2

(12) United States Patent
Hiorth et al.

(10) Patent No.: US 12,416,217 B2
(45) Date of Patent: Sep. 16, 2025

(54) WELL TOOL DEVICE FOR INJECTING A FLUID THROUGH A HOLE IN A WELL BORE

(71) Applicant: Interwell Norway AS, Hafrsfjord (NO)

(72) Inventors: Espen Hiorth, Trondheim (NO); Arild F. Stein, Sandnes (NO)

(73) Assignee: Interwell Norway AS, Hafrsfjord (NO)

( * ) Notice: Subject to any disclaimer, the term of this patent is extended or adjusted under 35 U.S.C. 154(b) by 0 days.

(21) Appl. No.: 18/269,798

(22) PCT Filed: Jan. 19, 2022

(86) PCT No.: PCT/EP2022/051088
§ 371 (c)(1),
(2) Date: Jun. 27, 2023

(87) PCT Pub. No.: WO2022/157175
PCT Pub. Date: Jul. 28, 2022

(65) Prior Publication Data

US 2024/0318523 A1 Sep. 26, 2024

(30) Foreign Application Priority Data

Jan. 25, 2021 (NO) ..... 20210089

(51) Int. Cl.
*E21B 33/127* (2006.01)
*E21B 33/124* (2006.01)

(52) U.S. Cl.
CPC ..... *E21B 33/1277* (2013.01); *E21B 33/1243* (2013.01)

(58) Field of Classification Search
CPC ..... E21B 33/1277
See application file for complete search history.

(56) References Cited

U.S. PATENT DOCUMENTS 2,441,894 A 5/1948 Mennecier
4,043,192 A 8/1977 Shuck
(Continued)

FOREIGN PATENT DOCUMENTS

DE 972254 C 6/1959
EP 3299575 A2 3/2018
(Continued)

OTHER PUBLICATIONS

International Search Report issued in PCT/EP2022/051088 on May 19, 2022 (5 pages).
(Continued)

*Primary Examiner* — Nicole Coy
*Assistant Examiner* — Jennifer A Railey
(74) *Attorney, Agent, or Firm* — Osha Bergman Watanabe & Burton LLP

(57) ABSTRACT

A well tool device, which is for injecting an injection fluid through a hole in a well bore, includes a mandrel, an expandable sleeve provided circumferentially outside of the mandrel, a first and second expander, an injection fluid system, and a control fluid system. The first expander is for moving a first side of the expandable sleeve between a radially retracted state and a radially expanded state. The second expander is for moving a second side of the expandable sleeve between a radially retracted state and a radially expanded state. The injection fluid system includes an injection fluid line and a nozzle element. The nozzle element provides fluid communication between the injection fluid line and an outlet provided on the outside of the expandable sleeve. The control fluid system controls the fluid pressure in a first fluid compartment provided radially between the expandable sleeve and the mandrel.

21 Claims, 10 Drawing Sheets

(56) References Cited

U.S. PATENT DOCUMENTS

| | | | | |
|---|---|---|---|---|
| 5,549,159 | A * | 8/1996 | Shwe | E21B 49/10 166/100 |
| 5,803,186 | A | 9/1998 | Berger et al. | |
| 7,866,387 | B2 * | 1/2011 | van Zuilekom | E21B 33/1243 166/54.1 |
| 2014/0190684 | A1 | 7/2014 | Hiorth | |
| 2015/0176405 | A1 * | 6/2015 | Corre | E21B 49/081 166/264 |
| 2017/0030157 | A1 | 2/2017 | Hansen et al. | |
| 2017/0138187 | A1 | 5/2017 | Moronkeji et al. | |
| 2019/0093465 | A1 | 3/2019 | Bryant et al. | |

FOREIGN PATENT DOCUMENTS

| | | | |
|---|---|---|---|
| NO | 329699 | B1 | 12/2010 |
| WO | 2019/083922 | A1 | 5/2019 |

OTHER PUBLICATIONS

Written Opinion of the International Searching Authority issued in PCT/EP2022/051088 on May 19, 2022 (9 pages).
Norwegian Search Report issued in NO 20210089 mailed on Aug. 16, 2021 (2 pages).

* cited by examiner

WELL TOOL DEVICE FOR INJECTING A FLUID THROUGH A HOLE IN A WELL BORE

FIELD OF THE INVENTION

The present invention relates to a well tool device for injecting an injection fluid through a hole in a well bore. The present invention also relates to a method for injecting an injection fluid through a hole in a well bore. The present invention also relates to a well tool device for bringing a treatment fluid into contact with a confined section of a well bore. The present invention also relates to a well tool device for receiving a fluid from a confined section of a well bore.

BACKGROUND OF THE INVENTION

It is referred to FIG. 1, where it is shown an oil and gas well bore WB, wherein a production liner or production tubing PT is installed for the purpose of transferring oil/gas to the top of the well. A screen SC is often installed outside of the production tubing PT, wherein oil/gas flows (indicated with dashed arrows) into the screen and further via holes or perforations H into the production tubing PT and further topside.

The screen is typically used in sand control applications to support the gravel pack.

The well bore WB may have more than one screen where oil/gas is flowing into the production tubing PT from different zones of the oil/gas containing formations. It is not uncommon that one or more such zones starts to produce water. In such wells, it is desired to stop or at least considerably reduce the amount of produced water, while maintaining produced oil/gas.

It is known to use straddles or straddle packers to isolate such water producing zones. One disadvantage of such straddles is that they form a restriction within the production tubing, as the inner diameter of the straddle is smaller than the inner diameter of the production tubing.

US 2017/0030157 discloses a wellbore intervention tool comprising a mandrel, an upper centralizer/sealing device, a lower centralizer/sealing device spaced apart from the upper centralizer/sealing device. Fluid may flow through the wellbore intervention tool toward the surface via fluid communication ports in the housing. It should be noted that these communication ports are located between the upper centralizer/sealing device and the lower centralizer/sealing device. During injection, the well bore between the upper centralizer/sealing device and the lower centralizer/sealing device will be filled with the injection fluid.

From NO329699 (Cannseal AS) it is known a well tool and method for in situ introduction of a fluid or treatment means into a region of an annulus, comprising: an anchoring body; a perforation device for making a hole through a pipe structure; a storage chamber for the treatment means; a driving means for the treatment means; and a flow-through connection device for injection of the treatment means. The distinctive characteristic is that the anchoring body is disposed in an anchoring module; wherein the storage chamber, the driving means and the connection device are operatively connected to an injection module; wherein the injection module can be moved axially relative to the anchoring module for moving the connection device in vicinity of the hole; and wherein the well tool comprises at least one alignment means for alignment and connection of the connection device vis-à-vis the hole.

Here, the exact location of the hole made by the perforation device is known and it is therefore easy to inject fluid into the hole.

One object of the invention is to inject fluid into a hole in the well bore, where the exact location of the hole is not known.

A further object of the invention is to be able to inject fluid into several holes in the well bore in one single run.

One object of the invention is to provide an improved well tool device for injecting a fluid through a hole in a well bore, where the inner diameter of the well bore is not considerably reduced after the injection process.

A further object of the invention is to provide a well tool device which may pass through a section of the well bore with relatively small inner diameter and further inject the fluid into a hole in an section of the well bore with relatively larger inner diameter, the hole being located below the small inner diameter section.

SUMMARY OF THE INVENTION

The present invention relates to a well tool device for injecting an injection fluid through a hole in a well bore, comprising:

- a mandrel;
- an expandable sleeve provided circumferentially outside of the mandrel;
- a first expander for moving a first side of the expandable sleeve between a radially retracted state and a radially expanded state;
- a second expander for moving a second side of the expandable sleeve between a radially retracted state and a radially expanded state;
- an injection fluid system comprising an injection fluid line and a nozzle element, wherein the nozzle element is providing fluid communication between the injection fluid line and an outlet provided on the outside of the expandable sleeve;
- a control fluid system for controlling the fluid pressure in a first fluid. compartment provided radially between the expandable sleeve and the mandrel.

In one aspect, the injection fluid is a treatment fluid, a sealing fluid, a chemical heating mixture, a hydraulic fluid etc. In one aspect, the fluid is a liquid, a gel etc. In one aspect, the fluid comprises granulates dissolved in a liquid. In one aspect, the injection fluid is a molten metal, which becomes cooled down and solidifies in the hole in the well bore.

The hole in the well bore may be one hole or several holes. The hole may be a hole of a screen in the well bore, one or a plurality of perforation holes in the well bore, cracks in a cemented area of a well bore, cracks or apertures in the formation etc. The may also be an interval or length of holes, such as a predrilled base pipe or a perforated interval of a well bore.

The hole may also refer to leaks in the well pipe, for example leaks in threaded joints of casing or production tubing.

In one aspect, the fluid in the control fluid system is a control fluid, for example a hydraulic fluid. Hence, the first fluid compartment may be referred to as a control fluid compartment.

In one aspect, the expandable sleeve is in a radially expanded state when the first fluid compartment is filled with control fluid and wherein the expandable sleeve is in a radially retracted state when the first fluid compartment is emptied of control fluid.

In one aspect, a second fluid compartment is defined radially outside of the expandable sleeve and axially between the first expanding device and the second expanding device when the first expanding device and the second expanding device are in their radially expanded states, wherein the second fluid compartment is configured to be supplied with injection fluid from the injection fluid system.

The second fluid compartment may be referred to as an injection fluid compartment.

In one aspect, the second fluid compartment is defined radially outside of the expandable sleeve and radially inside of the well bore.

In one aspect, the injection fluid line is provided as a bore in the mandrel, wherein a first end of the nozzle element is movably connected to the injection fluid line.

In one aspect, the first end of the nozzle element is displaceably arranged within the injection fluid line. In one aspect, the first end of the nozzle element is sealingly engaged within the injection fluid line.

In one aspect, the nozzle element is secured to the expandable sleeve.

In one aspect, a second end of the nozzle element is secured to the expandable sleeve. The outlet is also provided in the second end of the nozzle element.

In one aspect, the nozzle element will be pulled a distance out from the injection fluid line when the expandable sleeve is brought to its expanded state and the nozzle element will be pushed into the injection fluid line when the expandable sleeve is brought to its retracted state. Hence, movement of the nozzle element will either shorten or lengthen the fluid path of the injection fluid.

In one aspect, the injection fluid system comprises an injection fluid supply unit. The injection fluid supply unit may comprise a fluid source and a pump for pumping the injection fluid from the fluid source and into the injection fluid line.

Alternatively, the injection fluid supply unit is located topside, and the well tool device is connected to the fluid supply unit via fluid lines.

In one aspect, the control fluid system comprises a control fluid supply unit. The control fluid supply unit may comprise a fluid source and a pump for controlling the fluid pressure in the first fluid compartment.

In one aspect, the control fluid system comprises a control fluid sensor for measuring a parameter representative of the fluid pressure of the control fluid in the first fluid compartment.

In one aspect, the injection fluid system comprises an injection fluid sensor for measuring a parameter representative of the fluid pressure radially outside of the sleeve.

In one aspect, the injection fluid sensor and the control fluid sensor are connected to a control system configured to control the injection fluid supply unit and the control fluid supply unit.

In one aspect, the first expander and/or the second expander comprises:

- an expander ring provided circumferentially outside the mandrel;
- a actuator axially displaceable relative to the mandrel;
- wherein the expander ring is radially expanded by axial movement of the actuator in a first direction and wherein the expander ring is radially retracted by axial movement of the actuator in a second direction.

In one aspect, the first direction is a direction towards the middle of the expandable sleeve. Hence, the actuator of the first expander and the actuator of the second expander are moved towards each other for radially expanding the expander rings.

In one aspect, the second direction is a direction away from the middle of the expandable sleeve. Hence, the actuator of the first expander and the actuator of the second expander are moved away from each other for radially retracting the expander rings.

In one aspect, the actuator is moved towards a wedge-shaped surface of the mandrel during its movement in the first direction and/or wherein the actuator comprises a wedge-shaped surface.

In one aspect, the expander ring comprises a plurality of thimble-shaped elements inserted into each other, and an elastic ring/spring inserted into an opening of each of the plurality of thimble-shaped elements.

In one aspect, the actuator comprises a piston element, wherein the mandrel comprises a piston compartment in which the piston element is sealingly engaged; wherein the well tool device comprises an expander fluid system for controlling the fluid supplied to the piston compartment.

In one aspect, the actuator comprises a connection interface to which an end of the expandable sleeve is secured.

Alternatively, the ends of the expandable sleeve are secured to the mandrel.

In one aspect, the central area of the expandable sleeve comprises guiding grooves in its outwardly facing surface for guiding the injection fluid in the axial direction.

The first and second side areas do not comprise such guiding grooves, as such guiding grooves will reduce the sealing efficiency when pressed towards the well bore by the first and second expanders.

The present invention also relates to a method for injecting an injection fluid through a hole in a well bore, comprising the steps of:

- running a well tool device, the well tool device comprising a mandrel and an expandable sleeve radially outside of the mandrel, to the hole in the well bore;
- radially expanding a first expander for moving a first side of the expandable sleeve into contact with the well bore on a first side of the hole;
- radially expanding a second expander for moving a second side of the expandable sleeve into contact with the well bore on a second side of the hole;
- injecting the injection fluid through an outlet provided radially on the outside of the expandable sleeve and axially between the first and second sides of the expandable sleeve;
- expanding the expandable sleeve towards the well bore.

In one aspect, the step of injecting is performed before the step of expanding.

In one aspect, the step of expanding the expandable sleeve comprises:

- increasing the fluid pressure in a first fluid compartment provided radially between the expandable sleeve and the mandrel to a fluid pressure higher than the fluid pressure outside of the first fluid compartment.

In one aspect, the method comprises following steps prior to the step of injecting the injection fluid:

- measuring an initial pressure radially outside of the expandable sleeve;
- expanding the expandable sleeve towards the well bore;
- measuring a post expanding pressure radially outside of the expandable sleeve;
- verifying that a hole in the well bore is present axially between the first and second expander if the difference between the post expanding pressure and the initial pressure is lower than a threshold value.

Hence, if a hole is present in the well bore, the reduced volume caused by the expanding sleeve will not have caused an increase in pressure. However, if a hole is not present, the reduced volume caused by the expanding sleeve will have caused an increased pressure.

In one aspect, the above well tool device is deployed by e-line.

The present invention also relates to a e-line deployed well tool device for bringing a treatment fluid into contact with a confined section of a well bore, wherein the well tool device comprises:

a mandrel;

an expandable sleeve provided circumferentially outside of the mandrel;

a first expander for moving a first side of the expandable sleeve between a radially retracted state and a radially expanded state;

a second expander for moving a second side of the expandable sleeve between a radially retracted state and a radially expanded state;

a treatment fluid system comprising an outlet on the outside of the expandable sleeve, for supplying a treatment fluid to the confined section of the well bore, a fluid supply unit and a fluid line between the inlet and the fluid supply unit.

As the well tool device is deployed via e-line, coiled tubing and drill pipe can be avoided, thereby reducing the costs of the operation. As us known, e-line is corresponding to wireline with the addition of a signal conductor for providing communication between the well tool device and topside.

The present invention also relates to a well tool device for receiving a fluid from a confined section of a well bore, wherein the well tool device comprises:

a mandrel;

an expandable sleeve provided circumferentially outside of the mandrel;

a first expander for moving a first side of the expandable sleeve between a radially retracted state and a radially expanded state;

a second expander for moving a second side of the expandable sleeve between a radially retracted state and a radially expanded state;

a fluid receiving system comprising an inlet on the outside of the expandable sleeve, a fluid receiving unit and a fluid line between the inlet and the fluid receiving unit.

In one aspect, also the above well tool device is deployed by e-line.

In one aspect, the well tool device further comprises:

a control fluid system for controlling the fluid pressure in a first fluid compartment provided radially between the expandable sleeve and the mandrel.

In one aspect, the confined section is defined as the area of the well bore between the first side and the second side of the expandable sleeve in the expanded state.

According to the invention, it is possible to seal off a water zones in an efficient way, and hence avoid the considerably reduced inner diameter of a straddle.

According to the above, the amount of injection fluid present in the wellbore after the injection process is may be considerably reduced. Hence, it is still possible to retrieve the tool from the wellbore after the injection fluid has solidified.

DETAILED DESCRIPTION

Embodiments of the present invention will now be described in detail with reference to the enclosed drawings, wherein.

Figure 9A:
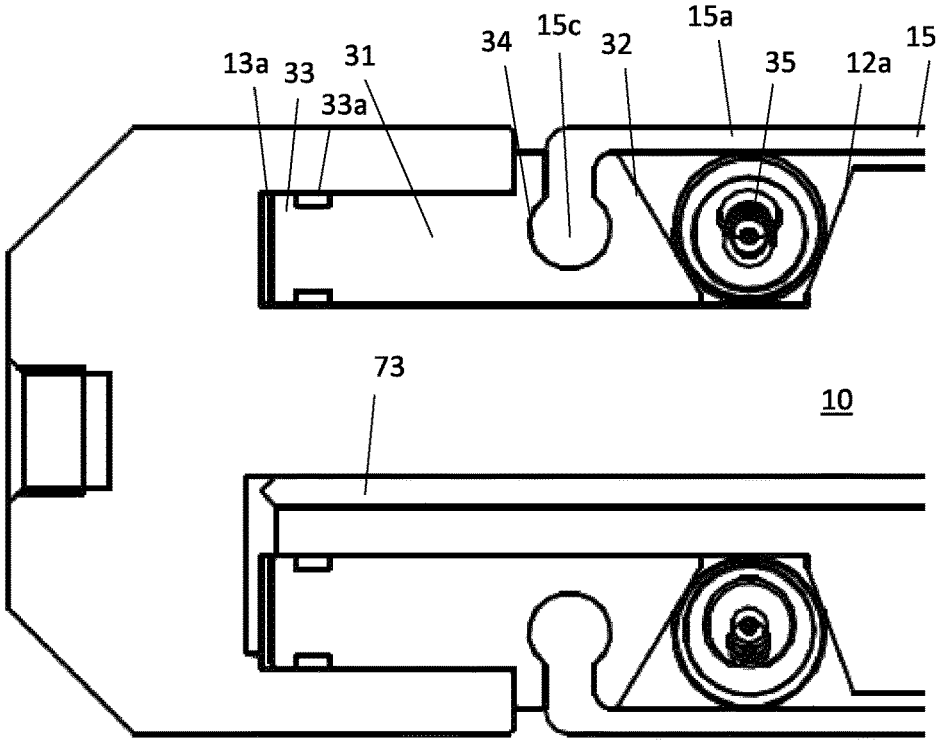
Figure 9B:
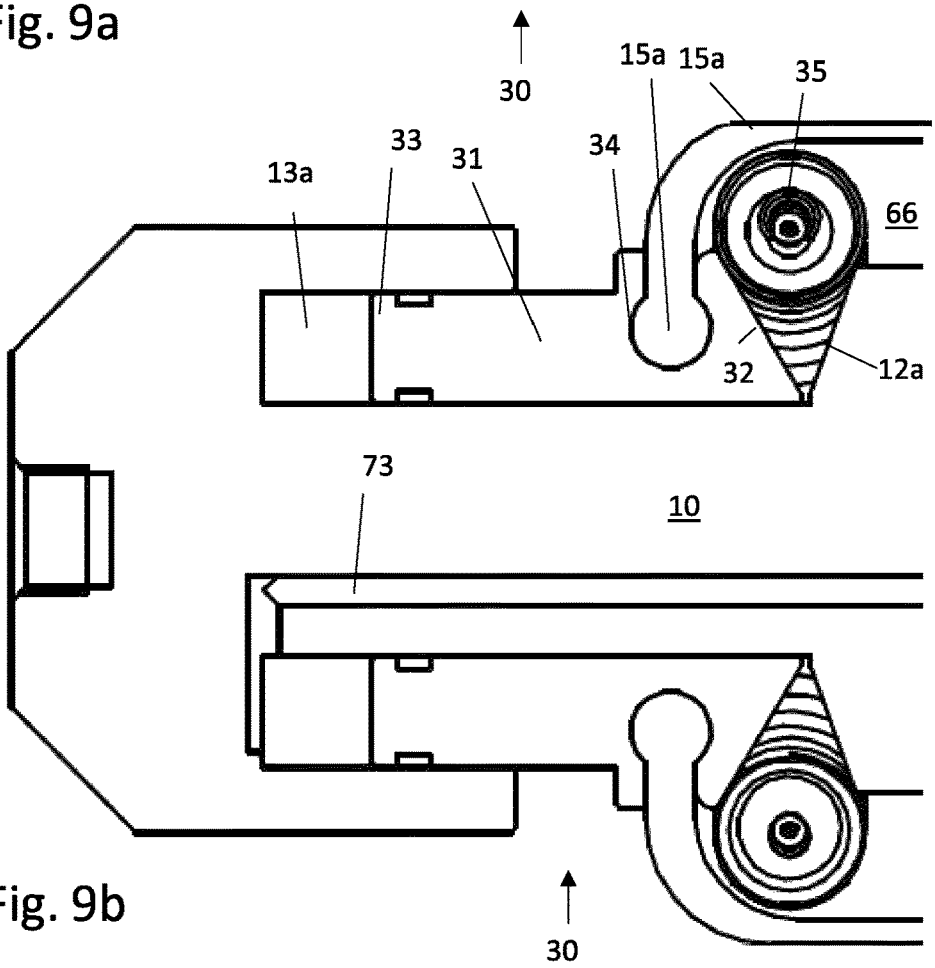
Figure 11A:
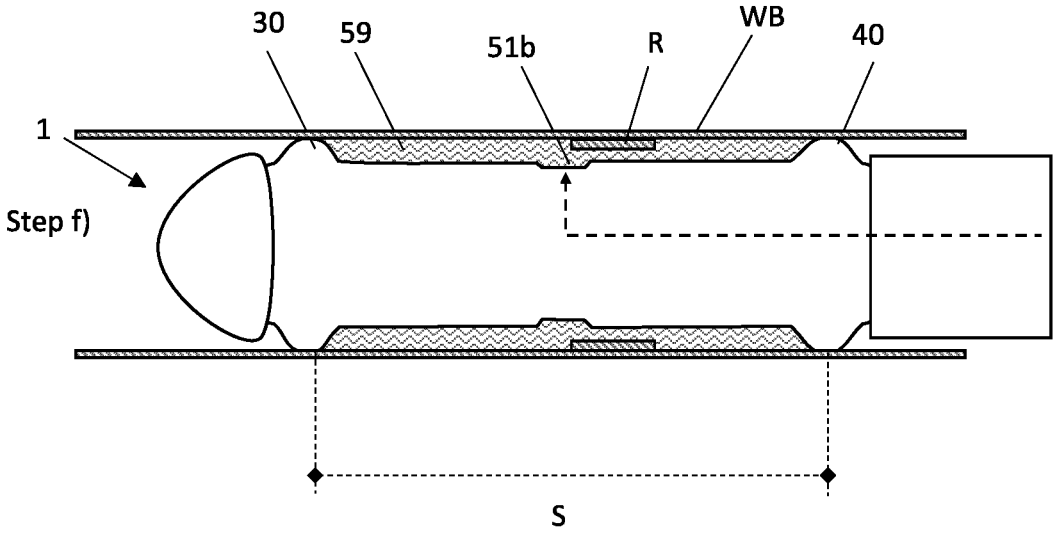
Figure 11B:
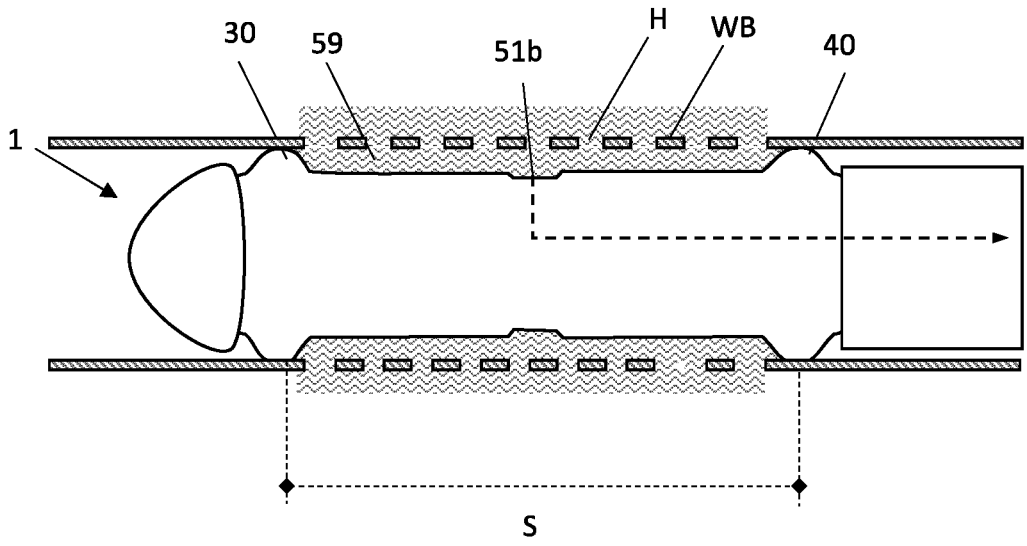
Figure 12A:
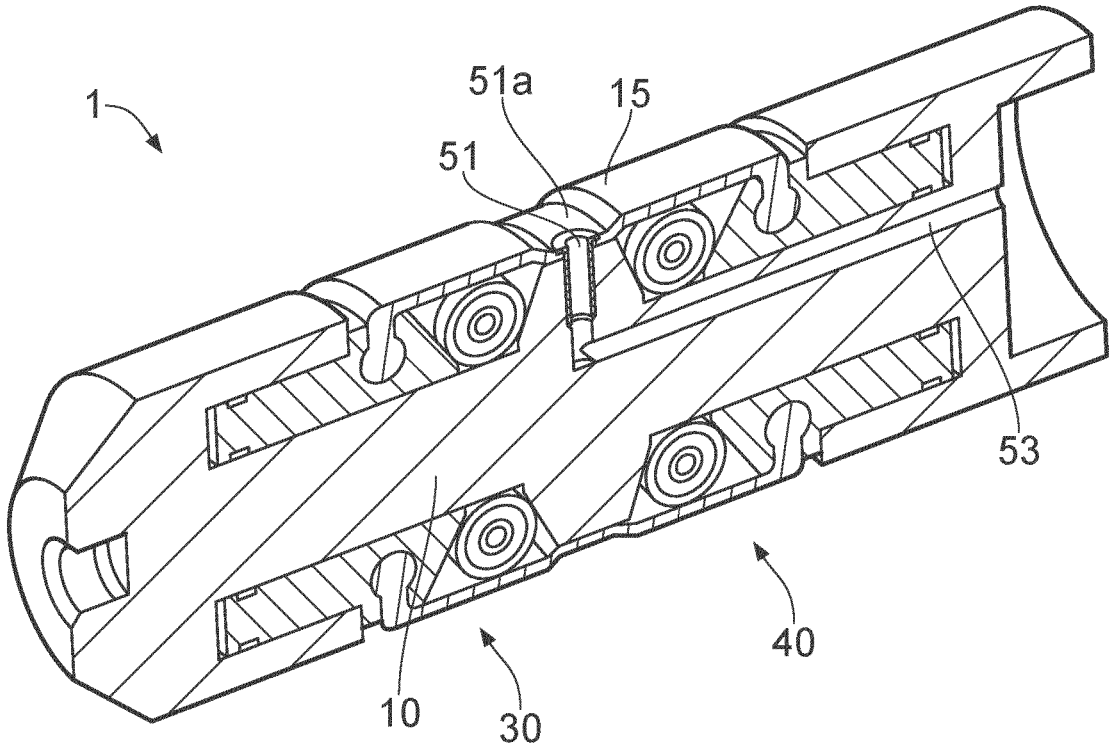
Figure 12B:
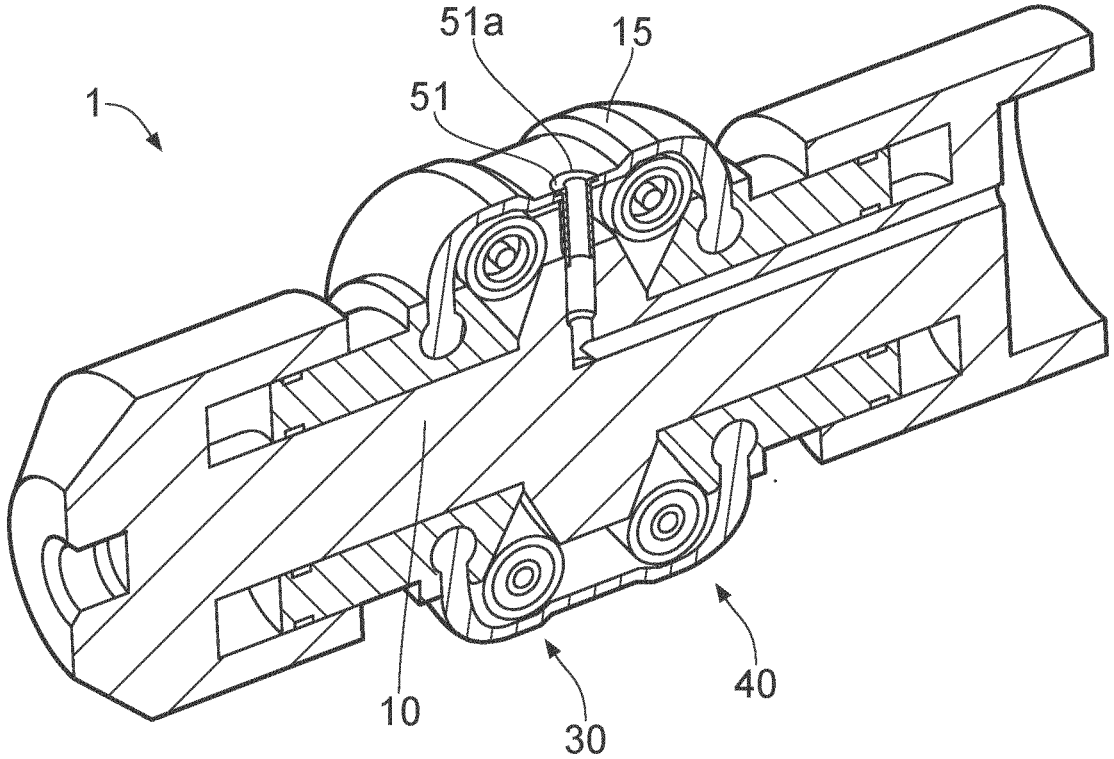

FIG. 9*a* is a cross sectional enlarged side view of the first expander in the run state;

FIG. 9*b* is a cross sectional enlarged side view of the first expander in the set state;

FIG. 10*a-j* illustrates different steps of the operation of the well tool device;

FIGS. 11*a* and 11*b* illustrates cross sectional views of alternative embodiments;

FIG. 12*a* illustrates a cross sectional perspective view of a further embodiment of the well tool device in the run state;

FIG. 12*b* illustrates a cross sectional perspective view of the embodiment in FIG. 12*a* in the set state.

Figure 1:
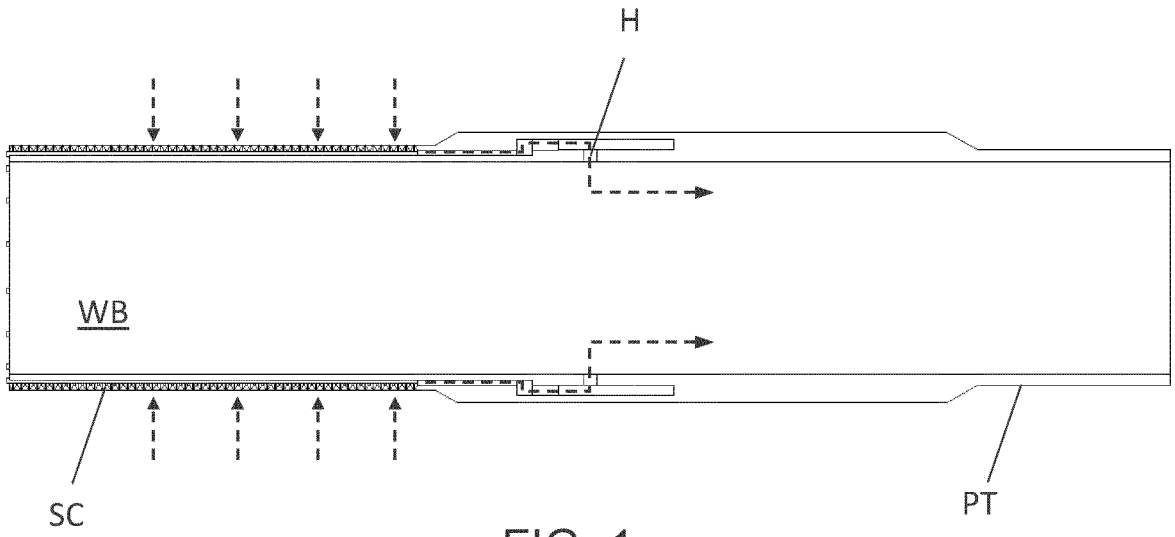
FIG. 1 illustrates a section of a well bore in which a screen is installed.
Figure 2:
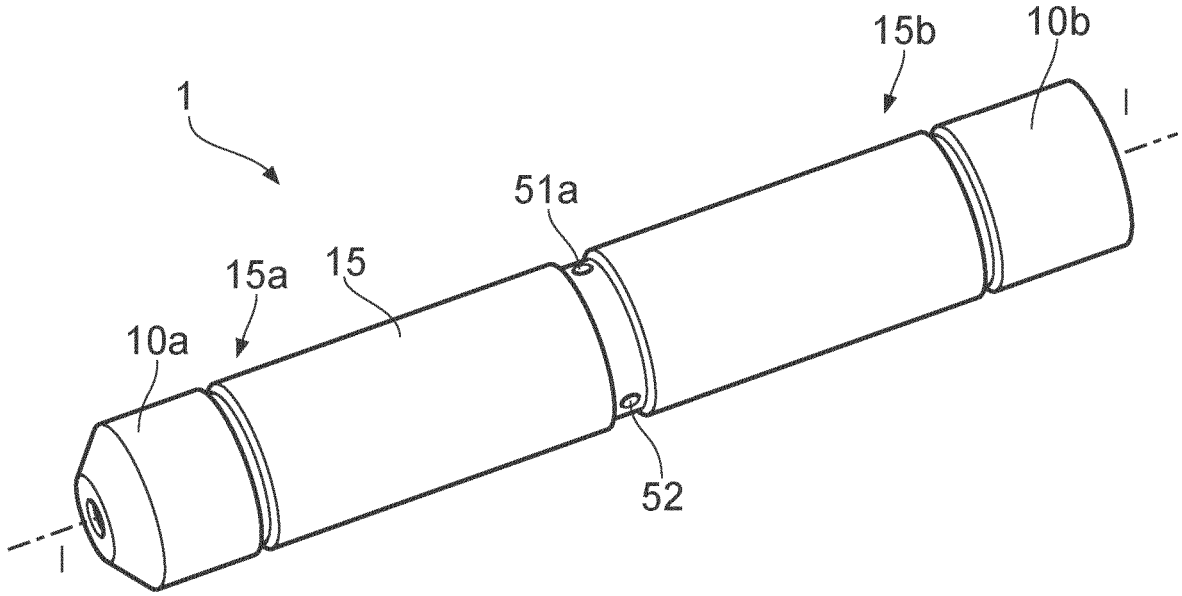
FIG. 2 illustrates a perspective view of the well tool device in the run state.
Figure 3:
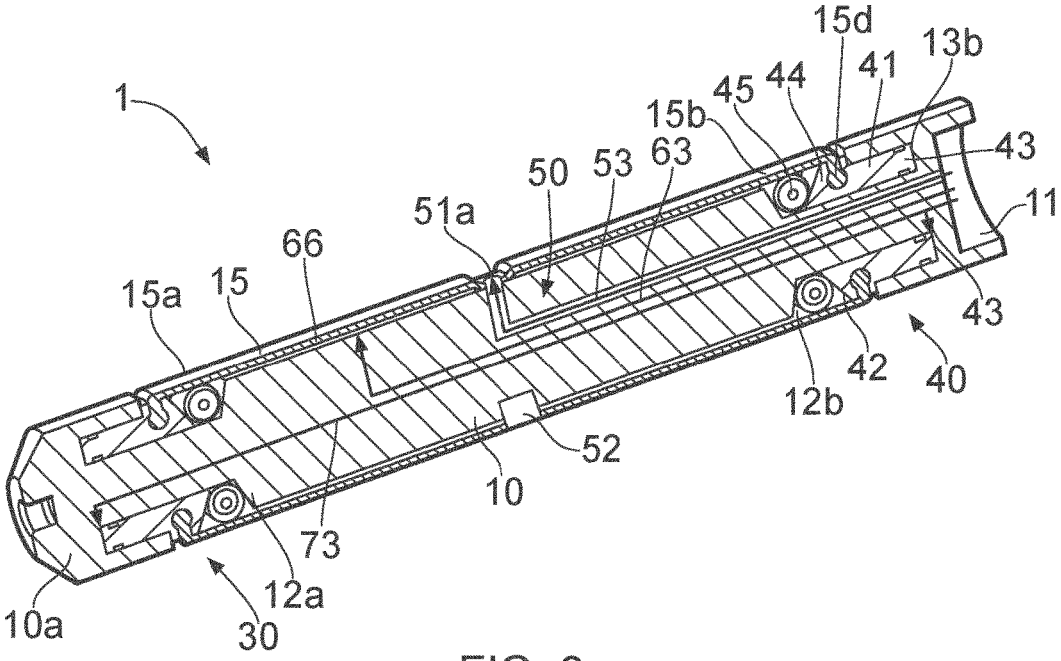
FIG. 3 illustrates a simplified cross sectional perspective view of the well tool device in the run state.

It is now referred to FIGS. 2 and 3, where a well tool device 1 for injecting an injection fluid through a hole H in a well bore WB is shown. First, the well tool device 1 will be described in detail, and then, the operation of the well tool device will be described in detail.

Well Tool Device

The well tool device 1 comprises a mandrel 10, indicated in FIG. 2 with its nose or lower end 10*a* and its upper end 10*b*. It should be noted that only parts of the upper end 10*b* are shown in comprises the drawings.

The well tool device 1 comprises an expandable sleeve 15 provided circumferentially outside of the mandrel 10, and axially between the lower end 10*a* and upper end 10*b*. The central axial direction or central longitudinal direction is indicated as a dashed axis I-I in FIG. 2. The expandable sleeve 15 is also indicated with its lower side 15*a* and its upper side 15*b*.

It should be noted that terms "upper", "above" etc. should be interpreted as "closer to the topside of the well", while the terms "lower", "below", etc. should be interpreted as "closer to the bottom of the well". It should further be noted that even though the well tool device in many situations will be oriented vertically, with the upper end 10*b* provided above the lower end 10*a*, the well tool device 10 may also be used in inclining and/or horizontal well bores WB.

Between the lower end 15*a* and the upper end 15*b*, an outlet 51*a* is provided in the expandable sleeve 15. It is further indicated a pressure sensor 52 for measuring a parameter representative of the pressure outside of the expandable sleeve 15.

Figure 6:
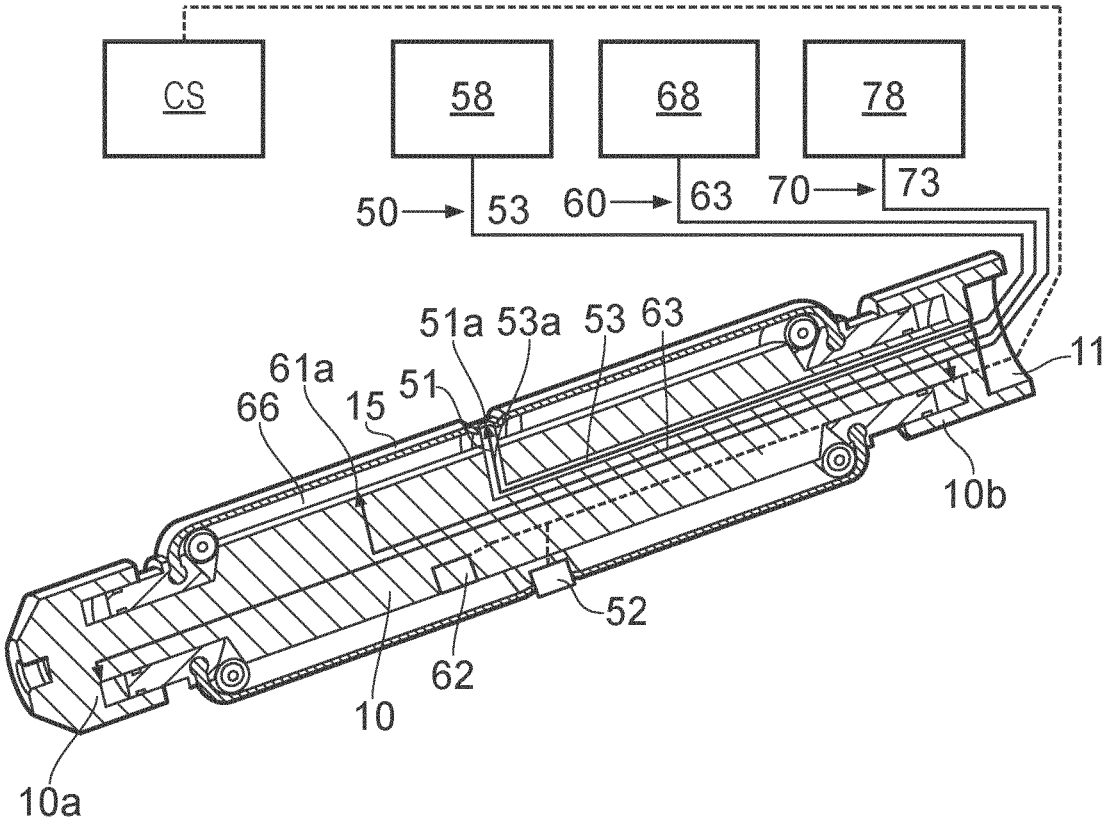
FIG. 6 is a cross sectional perspective view of the well tool device in FIG. 5.

It is now referred to FIG. 3. Here it is shown that the well tool device 1 comprises a first expander 30 and a second expander 40. The first expander 30 is configured to move the lower side 15*a* of the expandable sleeve 15 between a radially retracted state (FIG. 3) and a radially expanded state (FIG. 6). The second expander 40 is configured to move the upper side 15*b* of the expandable sleeve 15 between a radially retracted state and a radially expanded state.

In FIG. 3, it is also shown that the well tool device 1 comprises a first fluid compartment 66 radially between the expandable sleeve 15 and the mandrel 10.

The well tool device 1 further comprises an injection fluid system 50, a control fluid system 60, an expander fluid system 70 and a control system CS, as indicated in FIG. 6. As described above, only parts of the upper end 10*b* of the mandrel 10 is shown in the drawings. The upper end 10*b* of the mandrel 10 is connected to, or is forming, a housing 14 (FIG. 4) with a compartment 11, in which the injection fluid system 50, the control fluid system 60, the expander fluid system 70 and the control system CS are provided. Hence, the compartment 11 is forming a fluid system compartment 11. In the upper end of the housing 14, a connection interface 14*a* is shown. The connection interface 14*a* may be a wireline interface.

Figure 4:
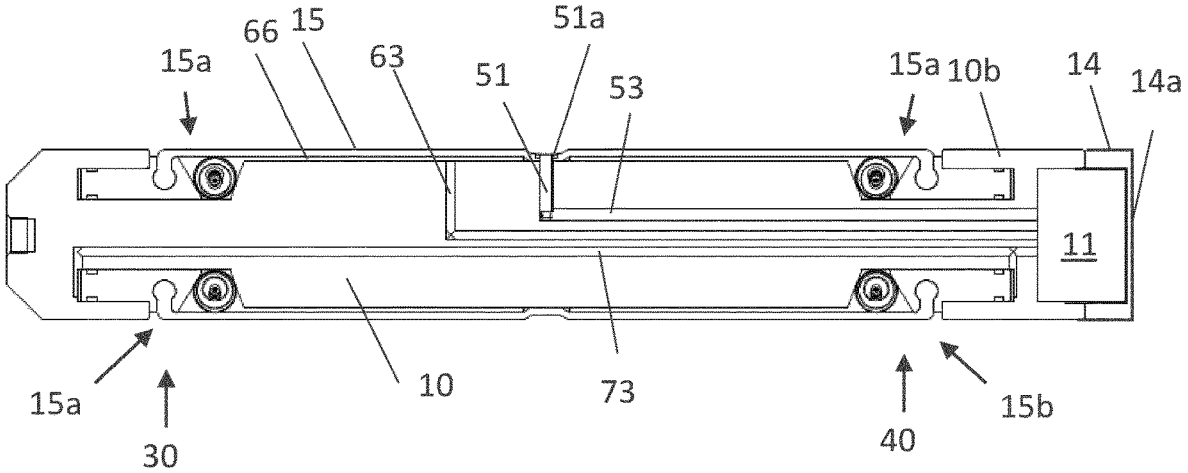
FIG. 4 is a cross sectional side view of one embodiment of the well tool device in the run state with all fluid lines.
Figure 5:
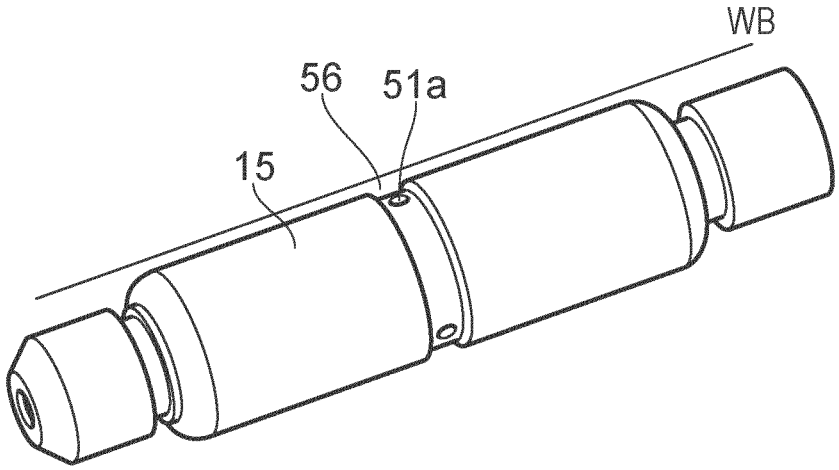
FIG. 5 is a perspective view of the well tool device in FIG. 2 in the set state.

It should be noted that the fluid system compartment 11 in FIG. 4 is considerably larger than indicated in FIG. 4.

The well tool device 1 is configured to be in the following main states:

- a run state, in which the first expander 30 and the second expander 40 are radially retracted and where there is no fluid in the first fluid compartment 66;
- a first set state, in which first expander 30 and the second expander 40 are radially expanded and where there is no fluid in the first fluid compartment 66;
- a second set state, in which first expander 30 and the second expander 40 are radially expanded and where the first fluid compartment 66 is fluid-filled;
- a retracting state, in which the first expander 30 and the second expander 40 are radially retracted, and where the first fluid compartment 66 is partially fluid-filled.

As will be apparent from the description below, the control fluid system 60 is used to supply control fluid to and to retract fluid from the first compartment 66, while the expander fluid system 70 is used to expand and retract the first expander 30 and the second expander 40.

The injection fluid system 50 will typically be used in the first and second set states, but not in the run state.

During retraction, i.e. when bringing the well tool device 1 from the second set state and back to the run state again, the retracting state is used to avoid that injection fluid is flowing back to the second compartment 56 when the first compartment 66 is emptied. If the first expander 30 and the second expander 40 were expanded, the emptying of the first compartment 66 would produce a vacuum in the second compartment 56, which could cause injection fluid to flow back. Hence, the first expander 30 and the second expander 40 are radially retracted, allowing fluid from the well bore WB to flow to the second compartment 56 during emptying of the first compartment 66.

Figure 7:
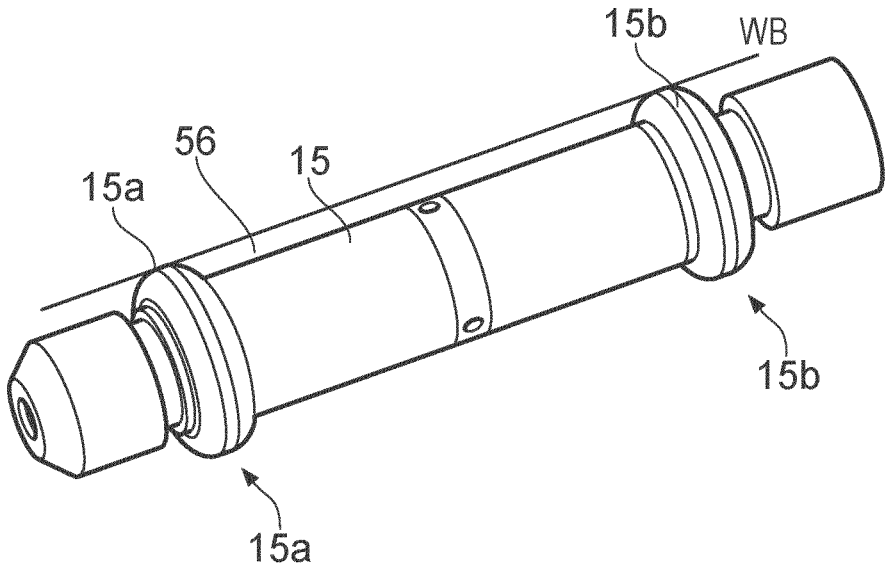
FIG. 7 is a perspective view of the well tool device in FIG. 5 in a set state and a non-pressurized first fluid compartment.
Figure 8:
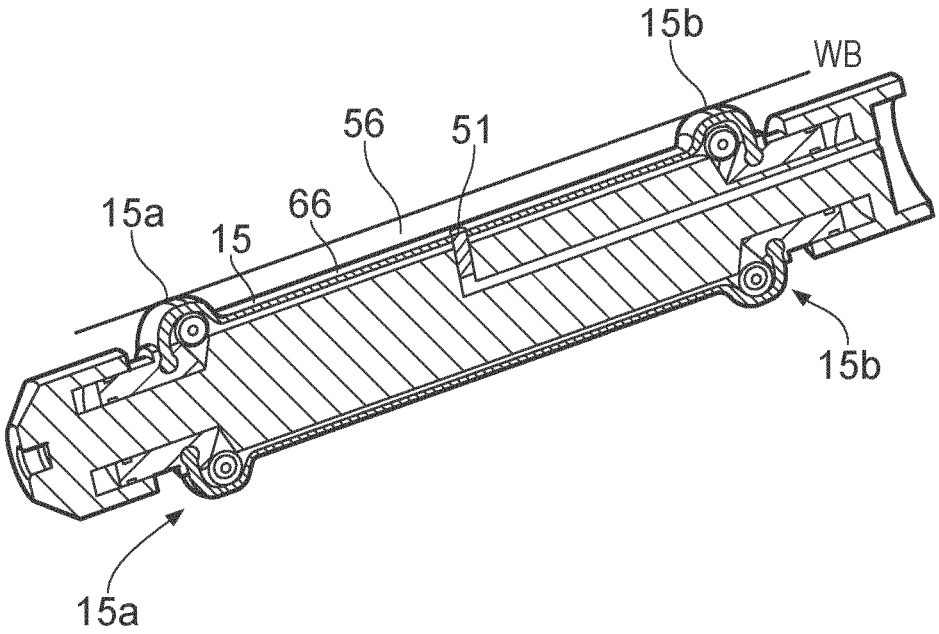
FIG. 8 is a perspective cross sectional view of the well tool device in FIG. 7.

It is now referred to FIGS. 7 and 8. Here, it is shown that a second fluid compartment 56 is defined radially outside of the expandable sleeve 15 and axially between the first expanding device 30 and the second expanding device 40 when the first expanding device 30 and the second expanding device 40 are in their radially expanded states towards the wellbore. The second fluid compartment 66 is defined radially outside of the expandable sleeve 15 and radially inside of the well bore WB. This compartment has a relatively large volume when the centre of the expandable sleeve is radially retracted (FIGS. 7 and 8) and has a relatively low volume when the centre of the sleeve 15 is radially expanded. This second fluid compartment 56 is configured to be supplied with injection fluid from the injection fluid system 50.

The second fluid compartment 56 may be referred to as an injection fluid compartment 56.

The Injection Fluid System 50

It is referred to FIG. 6, where it is shown that the injection fluid system 50 comprises an injection fluid supply unit 58 for supplying fluid to the injection fluid outlet 51*a* via an injection fluid line 53 and a nozzle element 51. The nozzle element 51 is a rigid element, for example made of metal, plastics etc.

The injection fluid supply unit 58 may comprise a fluid source and a pump for pumping the injection fluid from the fluid source and into the injection fluid line 53. It should be noted that the injection fluid supply unit 58 may comprise a heater for heating the injection fluid before the injection process. The injection fluid supply unit 58 may also comprise two or more fluid sources, which are mixed before the injection process. The injection fluid supply unit 58 may also inject two different injection fluids, i.e. the process starts by injecting a first fluid and then a second fluid is injected.

The injection fluid line 53 is provided as a bore within the mandrel 10. At the location of the outlet 51*a*, a section 53*a* of the injection fluid line 53 is oriented in a radial direction. Here, a first, inner end of the nozzle element 51 is displaceably and sealingly arranged within the section 53*a* of the injection fluid line 53. The second, outer end of the nozzle element 51 is secured to the expandable sleeve 15. The outlet 51*a* is provided in this second, outer end of the nozzle element 51.

When comparing FIG. 6 with FIG. 3, it can be seen that the expandable sleeve 15 is radially expanded with respect to the mandrel 10. Here, the nozzle element 51 will be pulled a distance out from the section 53*a* of the injection fluid line 53 when the expandable sleeve 15 is brought to its expanded state and the nozzle element 51 will be pushed into the injection fluid line 53 when the expandable sleeve 15 is brought to its retracted state. Hence, movement of the nozzle element 51 will either shorten or lengthen the fluid path of the injection fluid.

The Control Fluid System 60

The control fluid system 60 is controlling the fluid pressure within the first fluid compartment 66, i.e. the control fluid system 60 is supplying fluid into and is retracting fluid out from the compartment 66.

It is referred to FIG. 6, where it is shown that the control fluid system 60 comprises a control fluid supply unit 68 for supplying fluid to and from the control fluid outlet 61*a* via a control fluid line 63. The control fluid outlet 61*a* is provided in the end of the control fluid line 63 on the outer surface of the mandrel 10 and inside of the expandable sleeve 15.

The control fluid supply unit 68 may comprise a control fluid source and a pump for pumping the control fluid between the control fluid source and the first fluid compartment 66. Hence, the control fluid is used to expand and retract the expandable sleeve 15, as will be described in detail further below.

The First Expander 30 and the Second Expander 40

The first expander 30 will now be described with reference to FIGS. 9*a* and 9*b*. The first expander 30 comprises an expander ring 35 provided circumferentially outside the mandrel 10 and an actuator 31 axially displaceable relative to the mandrel 10.

The expander ring 35 may comprise a torus-shaped spiral spring, or it may comprise several torus-shaped spiral springs located inside each other. In the present embodiment, the expander ring 35 comprises a plurality of thimble-shaped elements inserted into each other to form a torus. A torus-shaped ring made of thimble-shaped elements are known from US2014/0190684 (Interwell Technology AS). Consequently, as this expander ring per se is considered prior art, it will not be described further in detail herein. In the above prior art document, it is described that a wire can inserted through respective openings of the thimble-shaped elements and hence to join the elements together. In the expander ring 35, a spiral spring may be inserted though the respective openings of the thimble-shaped elements. This spiral spring will help bringing the expander 30 from the expanded state to the retracted state.

The actuator 31 comprises a piston element 33 sealingly engaged within a piston compartment 13*a* of the mandrel 10. Recesses 33*a* for O-rings are provided on the piston element 33. As shown, a fluid line 73 is provided through the mandrel 10 between the piston compartment 13*a* and the expander fluid system 70, which will be described below.

The expander ring 35 is located between a wedge-shaped or inclining surface 12*a* of the mandrel 10 and a wedge-shaped or inclined surface 32 of the piston element 33. The two surfaces 12*a*, 32 together form a V-shape, causing the expander ring 35 to be pushed outwardly when the wedge-shaped surface 33 of the piston element 33 is pushed towards the wedge-shaped surface 12*a* of the mandrel 10, as shown in FIG. 9*b*. The expanding expander ring 35 will expand the first side 15*a* of the expandable sleeve 15 in a radial direction. When comparing FIG. 9*a* and FIG. 9*b*, it is apparent that there is more fluid in the piston compartment 13*a* in the expanded state (FIG. 9*b*) than in the retracted state (FIG. 9*a*).

The actuator 31 further comprises a connection interface 34 to which a lower end 15*c* of the expandable sleeve 15 is secured and sealingly engaged. Hence, in this embodiment, the O-rings of the actuator 31 also form a seal for the first fluid compartment 66.

The second expander 40 is identical to the first expander 30, and the parts 4*x* of the second expander 40 (shown in FIG. 3) have the same reference number as their counterpart 3*x* of the first expander 30, where x indicates a number and/or a number plus a character. The second expander 40 will therefore not be described further in detail herein. One exception is the inclining surface of the mandrel, which has reference number 12*a* for the first expander 30 and reference number 12*b* for the second expander 40. A second exception is the end of the expandable sleeve, which has reference number 15*c* for the first expander 30 and reference number 15*d* for the second expander 40. A third exception is piston compartment, which has reference number 13*a* for the first expander 30 and reference number 13*b* for the second expander 40.

In the present embodiment, the same expander fluid line 73 supplies expander fluid to both piston compartments 13*a*, 13*b*.

Figure 10A:
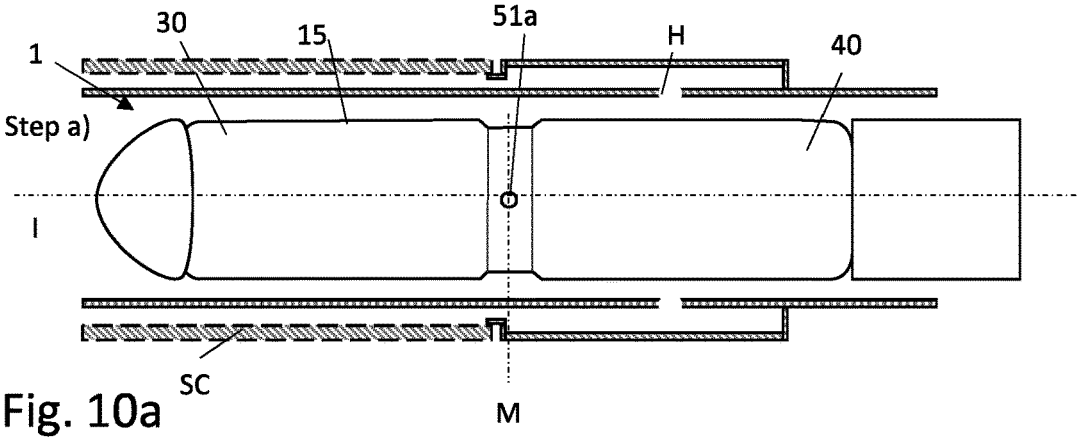
Figure 10B:
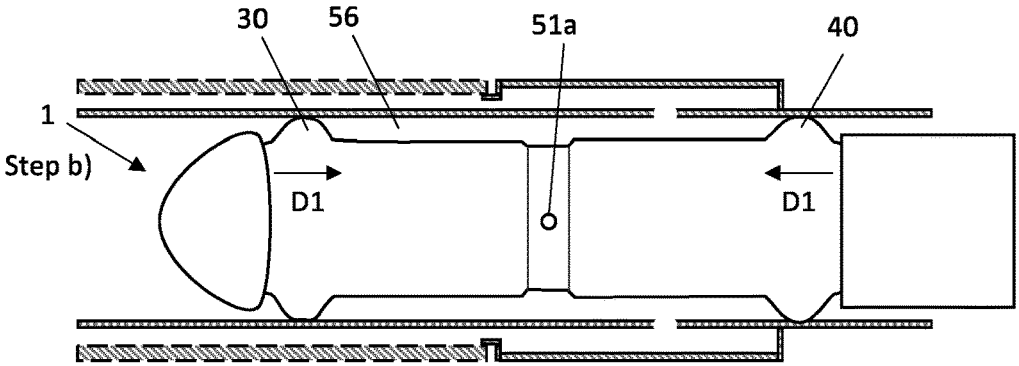

It should be noted that in the present embodiment, the piston elements 33, 43 both moves towards a middle M of the expandable sleeve 15 when moving from their retracted state to their expanded state, i.e. they move towards each other as indicated by arrows D1 shown in FIG. 10*b*. One effect of this is less tension in the expandable sleeve 15, making it easier to radially expand the expandable sleeve 15.

Figure 10C:
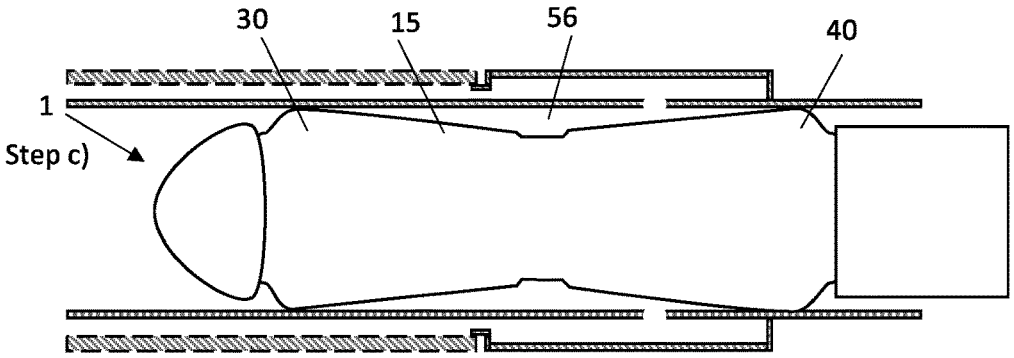
Figure 10D:
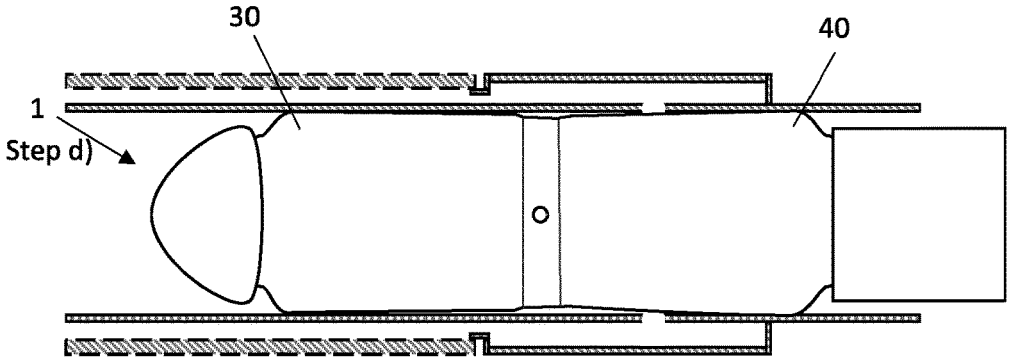
Figure 10E:
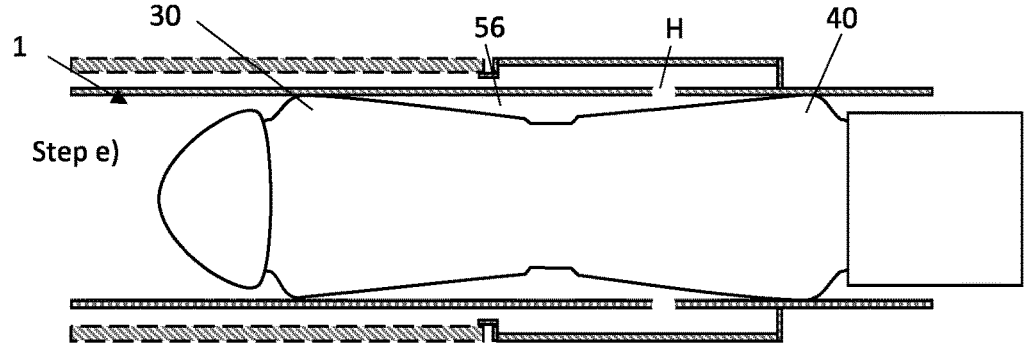
Figure 10F:
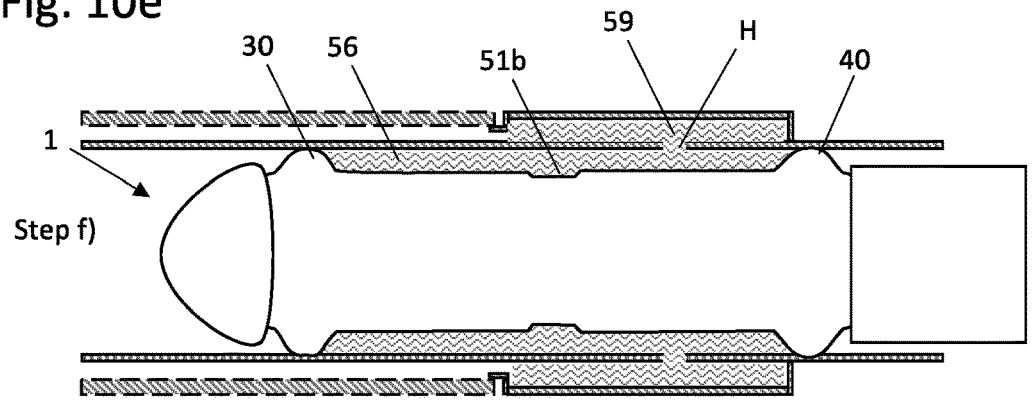
Figure 10G:
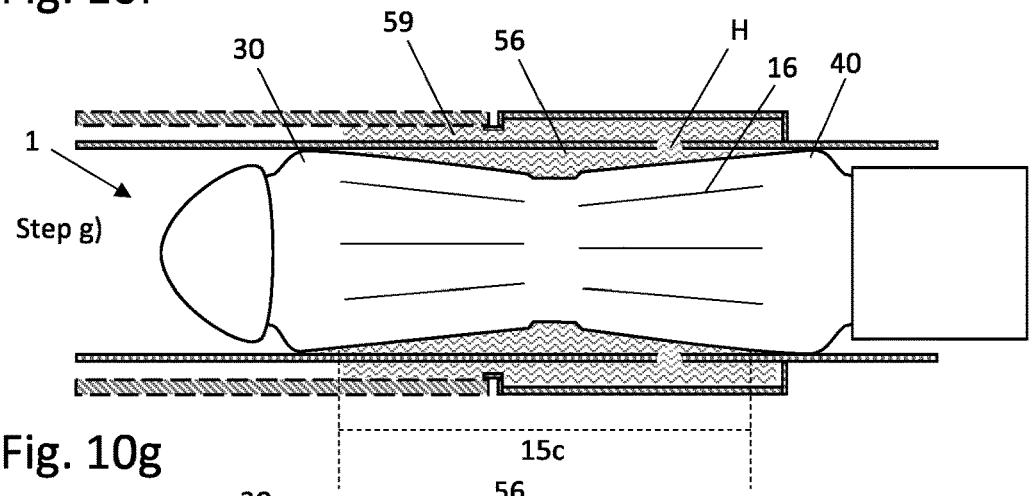
Figure 10H:
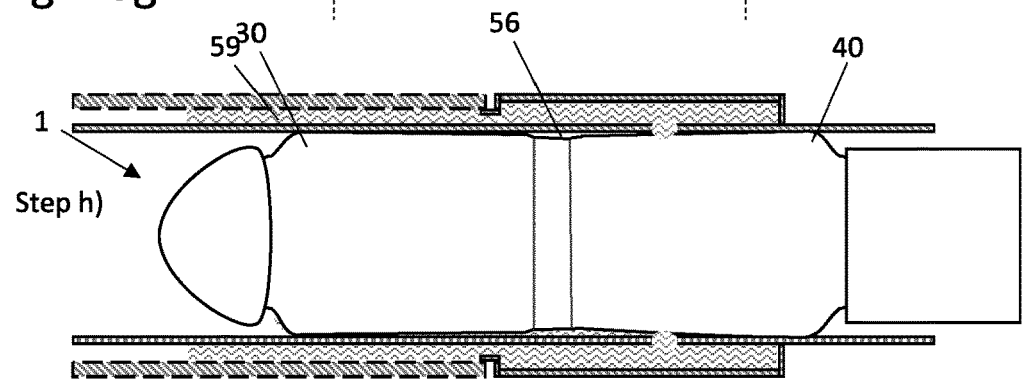
Figure 10I:
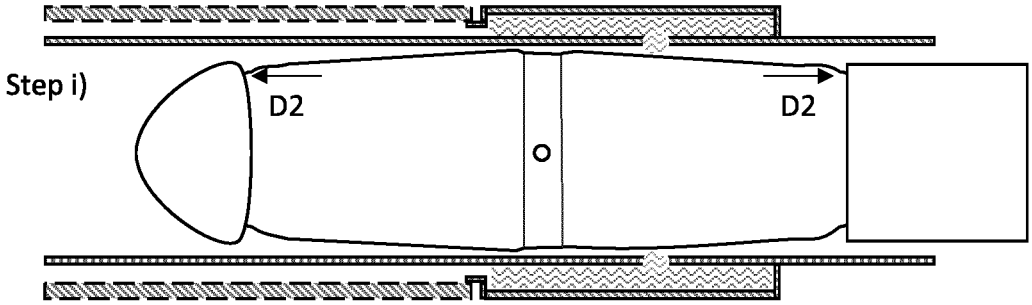

The piston elements 33, 43 both moves away from the middle M of the expandable sleeve 15 when moving from their expanded state to their retracted state, i.e. they move away from each other as indicated by arrows D2 shown in FIG. 10*i*. Here, the expandable sleeve 15 becomes tensioned again, making it easier to radially retract the expandable sleeve 15.

The Expander Fluid System 70

It is referred to FIG. 6, where it is shown that the expander fluid system 70 comprises an expander fluid supply unit 78 for supplying fluid to the piston compartments 13*a*, 13*b* via the expander fluid line 73.

The expander fluid supply unit 78 may comprise a fluid source and a pump for pumping the expander fluid between the fluid source and the respective piston compartments 13*a*, 13*b*.

The expander fluid line 73 is provided as a bore within the mandrel 10.

The expander fluid system 70 will typically be considered as a hydraulic fluid system where hydraulic fluid is used as the expander fluid.

The Control System CS

It is now referred to FIG. 6 again, where two sensors are shown, the first being the above-mentioned pressure sensor 52 for measuring a parameter representative of the pressure outside of the expandable sleeve 15. In addition, a second pressure sensor 62 is shown, for measuring a parameter representative of the pressure in the first compartment 66 (i.e. inside of the sleeve 15).

The pressure sensors 52, 62 are connected to the control system CS as indicated by dashed lines. The control system CS is controlling the pumps of the units 58, 68, 78 based on signals from the sensors 52, 62 and based on predetermined control parameters. It should be noted that the control system CS may be connected to a topside user interface, to manually control at least some of the operations of the well tool device 1.

In the above embodiment, the fluid supply units 58, 68, 68 are all located within the well tool device 10. At least parts of the control system CS may be located within the well tool device 10, where the user interface is connected to the control system CS via e-line.

Operation of the Well Tool Device

The operation of the well tool device 1 will now be described with reference to FIG. 10*a*-10*j*. The purpose of the operation is here to seal off a water-producing screen SC by injecting a sealing fluid into the hole H of the screen SC. The sealing fluid is here an epoxy, which will harden after injection into the hole H.

In step a) in FIG. 10*a*, the well tool device 1 is in the run state. The exact location of the hole H may or may not be known accurately, for the present well tool device 1 to work, it is sufficient that the hole H is located somewhere between the first expander 30 and the second expander 40 when initiating the setting of the well tool device 1.

Initially, a hole detection process is performed.

In step b) in FIG. 10*b*, the first expander 30 is expanded for moving a first side 15*a* of the expandable sleeve 15 into contact with the well bore WB on a first side of the hole H and the second expander 40 are expanded for moving a second side 15*a* of the expandable sleeve 15 into contact with the well bore WB on a second side of the hole H. This is done by controlling the expander fluid system 70 to pump fluid into the piston compartments 13*a*, 13*b*. As described above, this will move the piston elements 33, 43 in the direction D1, i.e. towards the middle M of the expandable sleeve 15.

In step c) and d) in FIGS. 10*c* and 10*d*, the initial pressure radially outside of the expandable sleeve 15 is measured by means of the pressure sensor 62. The expandable sleeve 15 is now expanded towards the well bore WB. This is done by controlling the control fluid system 60 to pump fluid into the first compartment 66. FIG. 10*c* shows a partially expanded sleeve 15. FIG. 10*d* shows an entirely expanded sleeve 15.

A post expanding pressure radially outside of the expandable sleeve 15 (i.e. the pressure after expansion of the sleeve 15) is measured by means of the pressure sensor 62.

If a hole H is present in the well bore WB axially between the first and second expander 30, 40, the post expanding pressure is expected to be approximately equal to the initial pressure, as the decreased volume caused by the expansion of the expandable sleeve 15 is small compared with the total volume (including the volume on the opposite side of the hole). However, if the difference between the post expanding pressure and the initial pressure is higher than a predetermined threshold value, i.e. a substantial pressure increase is measured by the pressure sensor 62, then it is assumed that no hole is present.

If it is confirmed that no hole H is detected, then the well tool device can be configured to its run state again, and then axially moved to a different position and the hole detection process is performed again in this different position.

If it is confirmed that a hole H is detected, the injection process may start.

In step e), FIG. 10*e*, the expandable sleeve 15 is at least partially retracted by reducing the amount of fluid in the first compartment 66, hence increasing the volume of the second compartment 56.

In step f), FIG. 10*f*, the injection fluid 59 is injected through the outlet port 51*b* by means of the injection fluid system 50. As shown, the volume in the first compartment 66 inside the sleeve 15 has been reduced, while the volume in the second compartment 56 outside of the sleeve has been increased, allowing a relatively large amount of injection fluid in the second compartment 56. It is assumed that this will increase the efficiency of injecting fluid into the hole H, as the exact location of the hole H is not known.

It is also shown in FIG. 10*f* that the injection fluid 59 has entered the hole H and has partially filled the rear side of the well bore WB or screen SC.

In step g), FIG. 10*g*, the injection of the injection fluid 59 by the injection fluid system 50 has stopped. Now, the control fluid system 60 is used to increase the volume in the first compartment 66 inside the sleeve 15, causing the volume in the second compartment 56 outside of the sleeve to decrease. Remnants of injection fluid 59 in the second compartment 56 will now be pressed from the second compartment 56 outside of the sleeve and into the hole H.

It is shown that a central area 15*c* of the expandable sleeve 15 defined as the area between, but not including the side areas 15*a*, 15*b* expanded by the first and second expanders 30, 40, comprises guiding grooves 16 in its outwardly facing surface. The purpose of these grooves 16 is to guide injection fluid in the axial direction towards the hole H during step g). It should be noted that the first and second side areas 15*a*, 15*b* do not comprise such guiding grooves 16, as such guiding grooves will reduce the sealing efficiency when pressed towards the well bore by the first and second expanders 30, 40.

Step h), FIG. 10*h*, is a continuation of step g), wherein the control fluid system 60 is used to increase the volume in the first compartment 66 inside the sleeve 15 further out into contact with the well bore WB. Here, the volume in the second compartment 56 outside of the sleeve 15 will be zero, or close to zero.

The well tool device 1 may be held in the state shown in FIG. 10*h*, for example to allow the injection fluid to solidify, to harden etc.

In step i), FIG. 10*i*, the first and second expanders 30, 40 are radially retracted by controlling the expander fluid system 70 to pump fluid out from the piston compartments 13*a*, 13*b* and hence moving the piston elements 33, 43 in the direction D2 as shown in FIG. 10*i*, i.e. away from the middle M.

As described above, this is done to avoid that injection fluid is sucked out from the hole H again due to a vacuum being created by emptying the first compartment 66 if the first and second expanders 30, 40 were not radially retracted.

Then, also in step i), first compartment 66 will be emptied.

Figure 10J:
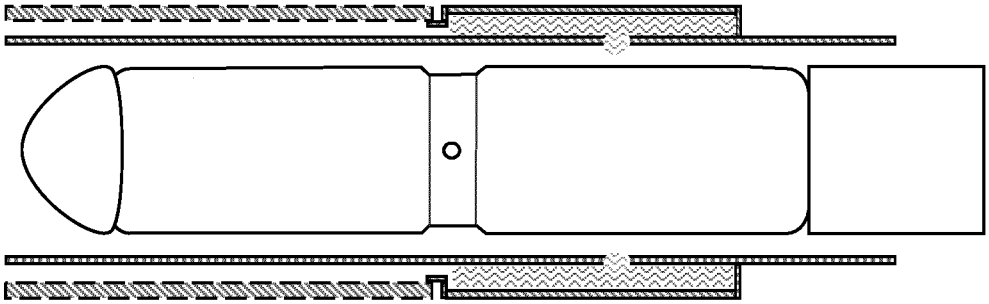

In step j), FIG. 10*j*, the well tool device 1 is in run state again and can be moved to a new hole at a different location in the well. As shown, the inner diameter of the well bore is as before the injection process started.

Other Application Areas

Above, the well tool device 1 was used to inject a sealing fluid, epoxy, into the hole H in the screen SC.

In a further example, the injection fluid may be a heat generation mixture which will generate heat when ignited. One example of such a heat generation mixture is thermite, which may be used during a plugging and abandonment operation, or which may be used to remove a well element by melting it. The heat generation mixture may be in the form of powder or granules mixed into a fluid.

In a further example, the injection fluid may be a molten metal. The metal may be a metal with low melting point (to avoid that the expandable sleeve becomes damaged by the molten metal) and/or it may be a metal which expands during cooling. One such metal is bismuth (Bi).

In a further example, the injection fluid may be a sealing fluid used to seal a threaded connection, for example a threaded connection between two tubing string sections. Occasionally, such threaded connections may leak, which is not desirable.

In a further example, the injection fluid is an actuation fluid (which may be a hydraulic fluid or any other type of suitable fluid) for local pressure actuation of well equipment, such as production regulating valves or other smart production regulating devices. Such well equipment is typically controlled via hydraulic fluid lines from topside. If one piece of equipment or a section of such equipment is malfunctioning, then this typically will affect the complete control system. By using the present tool, the malfunctioning piece of equipment may be locked in its position and sealed off with for example epoxy. In many wells, this will restore the function of the remaining control system.

In a further example, the injection fluid is an actuating fluid for actuating a production packer. Some production packers are actuated by applying a pressure to the inside of the well bore (here typically the production tubing). In some examples of prior art, the entire well bore is pressurized to achieve this. By using the well tool device 1, only the area necessary for the production packer to be actuated is pressurized.

In a further example, the injection fluid is epoxy. Here, the well tool device 1 is used to fill an open hole packer with epoxy. It is also possible to use the well tool device 1 to fill/expand a swell packer with epoxy.

In a further example, the injection fluid is a sealing fluid for sealing perforation channels in a cemented production tubing in which the water cut is high, to reduce the water production from the well. The injection fluid may seal perforations and cracks in the cement and may seal perforations and cracks in the formation outside of the cement.

It is now referred to FIG. 11*a*. Here, the purpose is not to inject a fluid into a hole of the well bore. Instead, the purpose is to bring a treatment fluid 59 into contact with a confined section S of a well bore WB. The confined section S is defined as the area of the well bore WB between the first side 15*a* and the second side 15*b* of the expandable sleeve 15 in the expanded state. The confined section S may comprise a restriction R. As shown, both sides of the restriction, and the restriction itself, may be threated as long as the inner diameter of the restriction allows the lower expander 30 of the well tool device 1 to be run past the restriction.

Here, the confined section S may comprise a sliding sleeve which has been stuck due to scaling, where the treatment fluid is an acid or other type of scale-removing fluid. After the treatment, the well tool device can be retrieved, and the sliding sleeve may be operated again.

It should be noted that in this last example, the control fluid system 60 for controlling fluid supply to and from the first fluid compartment 66 are not essential, only the first expander 30 and the lower expander 40 are needed to restrict the area of the well bore from which fluid should be received from. Hence, also the nozzle element allowing radial expansion of the fluid line is not essential.

It should be noted that the well tool device of FIG. 10*a*-10*j* may also work if the restriction R of FIG. 11*a* is present in the area of the hole H in FIG. 10*a*-10*j*.

Typically, this is an operation which today requires coiled tubing or drill pipe. According to the present well tool device, this may be performed by e-line.

It is now referred to FIG. 11*b*. Here, the well tool device 1 can be used to receive a fluid 59 from a confined section S of a well bore WB. In FIG. 11*b*, the confined section S is a perforated section of the well bore (typically production tubing), where fluids are allowed to enter the well bore from the formation. The above-described fluid supply unit may here form a fluid receiving unit 58 for receiving fluid, alternatively, the fluid may be transported to surface via fluid lines. The analysis may be performed topside. Alternatively, the well tool device 1 itself may comprise sensors for measuring desired parameters, such as fluid constituents (weight percentage or volume percentage) such as water cut, H2S content etc.

It should be noted that in FIG. 11*a*, 11*b*, the control fluid system 60 for controlling fluid supply to and from the first fluid compartment 66 are not essential, only the first expander 30 and the lower expander 40 are needed to restrict the confined section S. Hence, also the nozzle element allowing radial expansion of the fluid line is not essential.

It is now referred to FIG. 12*a* and FIG. 12*b*. This embodiment of the well tool device 1 is almost identical to the above embodiments, the one difference being the length of the well tool device being shorter. It should be noted that only one of the fluid lines are indicated in the drawing.

FURTHER ALTERNATIVE EMBODIMENTS

In the embodiments described above, parts of the fluid systems 50, 60, 70 are located in the fluid system compartment 11. In an alternative embodiment, the injection fluid supply unit 58, the control fluid supply unit 68 and/or the expander fluid supply unit 78 may be located topside wherein their respective fluid lines 53, 63, 73 are extending between the well tool device and the topside.

In the embodiments described above, the nozzle element 51 is pushed radially into and out from the radial section 53*a* of the injection fluid line 53. In an alternative embodiment, the nozzle element 51 itself is a flexible element connected between the injection fluid line 53 in the mandrel 10 and the expandable sleeve 15, for example a bellows, a flexible plastic tube etc.

In the embodiments described above, the injection fluid system 50 will typically be used in the first and second set states, but not in the run state. However, in some situations, it may be desired to flush away or clean excessive injection fluid from the outside of the expandable sleeve 15. In this case, the first and second expanders may be retracted or partially retracted after the injection process has finished. Then, a flushing or cleaning fluid may be flushed through the injection fluid line 53 and the nozzle element 51 to the outside of the expandable sleeve 15. In this state, the hole in the well bore has been filled by the initial injection fluid, and the flushing/cleaning fluid will typically not enter the hole H.

The invention claimed is:

1. A well tool device for injecting an injection fluid through a hole in a well bore, wherein the well tool device comprises:

a mandrel;

an expandable sleeve provided circumferentially outside of the mandrel;

a first expander for moving a first side of the expandable sleeve between a radially retracted state and a radially expanded state;

a second expander for moving a second side of the expandable sleeve between a radially retracted state and a radially expanded state;

an injection fluid system comprising an injection fluid line and a nozzle element, wherein the nozzle element is providing fluid communication between the injection fluid line and an outlet provided on the outside of the expandable sleeve;

a control fluid system for controlling the fluid pressure in a first fluid compartment provided radially between the expandable sleeve and the mandrel, the control fluid system for moving a portion of the expandable sleeve between the first and second expanders between a radially retracted state and a radially expanded state, wherein the first and second expanders are referred to as a set as A, wherein the portion of the expandable sleeve between the first and second expanders is referred to as B, and wherein A and B are independently operable between their respective retracted and expanded states.

2. The well tool device according to claim 1, wherein the expandable sleeve is in a radially expanded state when the first fluid compartment is filled with control fluid and wherein the expandable sleeve is in a radially retracted state when the first fluid compartment is emptied of control fluid.

3. The well tool device according to claim 1, wherein a second fluid compartment is defined radially outside of the expandable sleeve and axially between the first expanding device and the second expanding device when the first expanding device and the second expanding device are in their radially expanded states, wherein the second fluid compartment is configured to be supplied with injection fluid from the injection fluid system.

4. The well tool device according to claim 1, wherein the injection fluid line is provided as a bore in the mandrel, wherein a first end of the nozzle element is movably connected to the injection fluid line.

5. The well tool device according to claim 1, wherein the nozzle element is secured to the expandable sleeve.

6. The well tool device according to claim 1, wherein the injection fluid system comprises an injection fluid supply unit.

7. The well tool device according to claim 1, wherein the control fluid system comprises a control fluid supply unit.

8. The well tool device according to claim 1, wherein the control fluid system comprises a control fluid sensor for measuring a parameter representative of the fluid pressure of the control fluid in the first fluid compartment.

9. The well tool device according to claim 1, wherein the injection fluid system comprises an injection fluid sensor for measuring a parameter representative of the fluid pressure radially outside of the sleeve.

10. The well tool device according to claim 1, wherein the first expander and/or the second expander comprises:

an expander ring provided circumferentially outside the mandrel;

an actuator axially displaceable relative to the mandrel;

wherein the expander ring is radially expanded by axial movement of the actuator in a first direction and wherein the expander ring is radially retracted by axial movement of the actuator in a second direction.

11. The well tool device according to claim 10, wherein the actuator is moved towards a wedge-shaped surface of the mandrel during its movement in the first direction and/or wherein the actuator comprises a wedge-shaped surface.

12. The well tool device according to claim 10, wherein the actuator comprises a piston element, wherein the mandrel comprises a piston compartment in which the piston element is sealingly engaged; wherein the well tool device comprises an expander fluid system for controlling the fluid supplied to the piston compartment.

13. The well tool device according to claim 10, wherein the actuator comprises a connection interface to which an end of the expandable sleeve is secured.

14. The well tool device according to claim 1, wherein the central area of the expandable sleeve comprises guiding grooves in its outwardly facing surface for guiding the injection fluid in the axial direction.

15. A method for injecting an injection fluid through a hole in a well bore, wherein the method comprises:

running a well tool device, the well tool device comprising a mandrel and an expandable sleeve radially outside of the mandrel, to the hole in the well bore;

radially expanding a first expander for moving a first side of the expandable sleeve into contact with the well bore on a first side of the hole;

radially expanding a second expander for moving a second side of the expandable sleeve into contact with the well bore on a second side of the hole;

injecting the injection fluid through an outlet provided radially on the outside of the expandable sleeve and axially between the first and second sides of the expandable sleeve after the radial expansion of the first and second expanders; and expanding, after injection of the injection fluid, the expandable sleeve towards the well bore.

16. The method according to claim 15, wherein expanding the expandable sleeve comprises:

increasing the fluid pressure in a first fluid compartment provided radially between the expandable sleeve and the mandrel to a fluid pressure higher than the fluid pressure outside of the first fluid compartment.

17. The method according to claim 15, wherein the method comprises prior to injecting the injection fluid:

measuring an initial pressure radially outside of the expandable sleeve;

expanding the expandable sleeve towards the well bore;

measuring a post expanding pressure radially outside of the expandable sleeve;

verifying that a hole in the well bore is present axially between the first and second expander if the difference between the post expanding pressure and the initial pressure is lower than a threshold value.

18. An e-line conveyed well tool device for bringing a treatment fluid into contact with a confined section of a well bore, wherein the well tool device comprises:

a mandrel comprising a first piston compartment and a second piston compartment;

an expandable sleeve provided circumferentially outside of the mandrel;

a first expander for moving a first side of the expandable sleeve between a radially retracted state and a radially expanded state, the first expander comprising:

a first expander ring provided circumferentially outside the mandrel, and a first actuator axially displaceable relative to the mandrel comprising a first piston element sealingly engaged with the first piston compartment, wherein the first expander ring is radially expanded by axial movement of the first actuator in a first direction and wherein the first expander ring is radially retracted by axial movement of the first actuator in a second direction;

a second expander for moving a second side of the expandable sleeve between a radially retracted state and a radially expanded state, the second expander comprising:

a second expander ring provided circumferentially outside the mandrel, and a second actuator axially displaceable relative to the mandrel comprising a second piston element sealingly engaged with the second piston compartment, wherein the second expander ring is radially expanded by axial movement of the second actuator in a third direction and wherein the second expander ring is radially retracted by axial movement of the second actuator in a fourth direction;

a treatment fluid system comprising an outlet on the outside surface of the expandable sleeve, for supplying a treatment fluid to the confined section of the well bore, a fluid supply unit and a fluid line between the inlet and the fluid supply unit; and an expander fluid system for controlling a fluid pressure to the first and second piston compartments, wherein the first actuator and the second actuator are moved in response to the fluid pressure in the first and second piston compartments.

19. The well tool device according to claim 18, wherein the well tool device further comprises:

a control fluid system for controlling the fluid pressure in a first fluid compartment provided radially between the expandable sleeve and the mandrel.

20. The well tool device according to claim 18, wherein the confined section is defined as the area of the well bore between the first side and the second side of the expandable sleeve in the expanded state.

21. A well tool device for receiving a fluid from a confined section of a well bore, wherein the well tool device comprises:

a mandrel comprising a first piston compartment and a second piston compartment;

an expandable sleeve provided circumferentially outside of the mandrel;

a first expander for moving a first side of the expandable sleeve between a radially retracted state and a radially expanded state, the first expander comprising:

a first expander ring provided circumferentially outside the mandrel, and a first actuator axially displaceable relative to the mandrel comprising a first piston element sealingly engaged with the first piston compartment, wherein the first expander ring is radially expanded by axial movement of the first actuator in a first direction and wherein the first expander ring is radially retracted by axial movement of the first actuator in a second direction;

a second expander for moving a second side of the expandable sleeve between a radially retracted state and a radially expanded state, the second expander comprising:

a second expander ring provided circumferentially outside the mandrel, and a second actuator axially displaceable relative to the mandrel comprising a second piston element sealingly engaged with the second piston compartment, wherein the second expander ring is radially expanded by axial movement of the second actuator in a third direction and wherein the second expander ring is radially retracted by axial movement of the second actuator in a fourth direction;

a fluid receiving system comprising an inlet on the outside surface of the expandable sleeve, a fluid receiving unit and a fluid line between the inlet and the fluid receiving unit; and an expander fluid system for controlling a fluid pressure to the first and second piston compartments, wherein the first actuator and the second actuator are moved in response to the fluid pressure in the first and second piston compartments.

* * * * *